US011857038B2

(12) United States Patent
Yurman

(10) Patent No.: US 11,857,038 B2
(45) Date of Patent: Jan. 2, 2024

(54) JEWELRY WITH HINGE ASSEMBLY

(71) Applicant: David Yurman IP LLC, New York City, NY (US)

(72) Inventor: David M. Yurman, New York, NY (US)

(73) Assignee: David Yurman IP LLC, New York, NY (US)

( * ) Notice: Subject to any disclaimer, the term of this patent is extended or adjusted under 35 U.S.C. 154(b) by 79 days.

(21) Appl. No.: 17/575,530

(22) Filed: Jan. 13, 2022

(65) Prior Publication Data

US 2023/0218047 A1 Jul. 13, 2023

(51) Int. Cl.
*A44C 5/12* (2006.01)

(52) U.S. Cl.
CPC ..... *A44C 5/12* (2013.01)

(58) Field of Classification Search
CPC ..... A44C 5/12; A44C 7/004; A44C 7/006; A44C 7/007; A44C 7/008
See application file for complete search history.

(56) References Cited

U.S. PATENT DOCUMENTS 240,857 A * 5/1881 Smith ..... A44C 5/12 63/8
240,915 A * 5/1881 Mason ..... A44C 5/12 63/8
247,876 A * 10/1881 Becker ..... A44C 5/12 63/9
827,164 A * 7/1906 Macomber ..... A44C 5/12 63/8
5,468,220 A * 11/1995 Sucher ..... A61F 5/05866 63/8
5,522,529 A 6/1996 Yurman et al.
7,966,704 B2 6/2011 Yurman et al.
8,881,550 B2 * 11/2014 Huynh ..... A44C 7/007 63/12
9,591,900 B2 3/2017 Huynh
9,730,497 B2 8/2017 Huynh
9,955,758 B2 5/2018 Huynh
2013/0276478 A1 * 10/2013 Huynh ..... A44C 9/00 63/12
2016/0270490 A1 * 9/2016 Huynh ..... A44C 9/0046

FOREIGN PATENT DOCUMENTS

CH 275542 A * 7/1948 ..... A44C 5/12
JP 09065911 A 3/1997
JP 5822373 B1 11/2015

* cited by examiner

*Primary Examiner* — Jack W Lavinder
(74) *Attorney, Agent, or Firm* — Gordon & Jacobson, P.C.

(57) ABSTRACT

A piece of jewelry includes a hinge assembly that always biases two rigid portions to rotate relative to each other toward a closed secure position. The jewelry includes a leaf spring that biases a spring housing to rotate and thereby in turn rotate the two rigid portions relative to each other. The jewelry includes a pin in slot system which limits movement of the hinge to maximum predetermine opening angle.

22 Claims, 8 Drawing Sheets

JEWELRY WITH HINGE ASSEMBLY

BACKGROUND OF THE INVENTION

1. Field of the Invention

The present invention relates to hinges for jewelry to permit a rigid piece of jewelry to be opened and closed for fitting about a portion of a wearer. More particularly, the present invention is related to spring-biased hinges for jewelry.

2. State of the Art

Jewelry pieces that extend about a portion of the human body require some manner to secure and release the position of the ends of the jewelry in relationship to each other so that the jewelry may be retained on the body portion and removed from the body portion. For flexible jewelry, such as a chain bracelet, a clasp in some form is used to retain ends of the jewelry to each other. For rigid jewelry, such as a wrist cuff that has an opening too small to pass the wrist through, the jewelry requires some hinge assembly that permits one portion of the cuff to move relative to the other portion so that the opening can be enlarged for passing the body portion.

Generally, such hinge assemblies can be bulky and protrude from the piece breaking the intended aesthetic. In addition, if the hinge assembly is design to eliminate the bulk, the hinge assembly is often too delicate and cannot withstand a suitable cycle of use before failure. Further such hinges are often not suitably design to secure jewelry on a user.

SUMMARY OF THE INVENTION

A piece of jewelry defines a rigid band or cuff adapted to extend preferably more than 270° about a body portion of a wearer. The band or cuff may be round, oval or any other shape to fit or otherwise extend about a body part, such as the wrist, ankle, neck, ear lobe or cartilage, or finger. The band or cuff includes a first hinge end and an arm rotatably coupled to the first portion at a hinge. The arm can be rotated open relative to the hinge end to permit the body portion of the wearer to be received within the band or cuff. The arm may then be closed such that the band or cuff captures the body portion and is retained on the body portion. According to a preferred aspect, the hinge is always biased toward the closed position such that the arm is always urged closed.

The first hinge end has a reduced width and a central recess defining a first pair of fingers. A first hinge bore extends widthwise through the end, and a second coupling bore extends widthwise through the first pair of fingers and across the central recess. A track element is sized to fit between the first pair of fingers and includes a third coupling bore that extends widthwise through the track element and aligns with the second coupling bore, and a non-circular slot. The track element is fixed in the central recess between the first pair of fingers with a pin that extends through the second and third coupling bores. A portion of the track element provided with the non-circular slot projects outward from the first pair of fingers. The track element may be distinct from or an integrated portion of the first hinge end.

The arm has a second hinge end and a free end. The second hinge end has a second pair of fingers sized to fit about the reduced width portion of the first hinge end of the cuff. A second hinge bore extends widthwise through the second pair of fingers and a first hinge pin couples the arm to the first hinge end such that the arm is rotatable relative to the first hinge end. The arm also includes an interior housing recess extending from the second hinge end toward the free end, a well, and a spring tunnel that extends below the housing recess and which opens at the lower end of the well. The arm includes a third hinge bore extending widthwise across the arm and through the housing recess.

An elongate housing includes a first end and a second end. The housing is sized to be received within the housing recess of the arm. The housing has a first surface that matches the surface of the housing recess of the arm, and a second surface that allows the housing to seat flush with the arm. The first end includes a third pair of fingers and a fourth hinge bore extending widthwise through the third pair of fingers, and a second end with a fifth hinge bore extending widthwise across the second end of the housing. The second surface of the housing includes a channel that is open to the first surface and a retaining lip along the first surface of the first end.

A leaf spring is positioned in the channel of the housing, retained under the lip, and extends into the tunnel under the lower end of the well. In an embodiment, the leaf spring is constructed of a stack of flat springs. A second hinge pin couples the second end of the housing arm to the first hinge end at the third hinge bore. A stopper pin extends through the third pair of fingers and the elongate slot of the track element to couple the first end of the housing arm to the elongate track. A cap is provided in the well to secure the leaf spring in position between the housing and the arm. While the leaf spring resides in the channel, it is not fixed to any hinge point. The leaf spring positioned between the arm and the housing operates to bias the first end of the housing toward the arm and thereby always urge the cuff into a close position; that is, the only stable position is a closed position.

In accord with the hinge construction, the stopper pin is displaced within the elongate slot as the arm is rotated relative to the first hinge end. As the cuff arm is rotated from a closed position to an open position, the pin starts at a first end of the slot, is displaced to an opposite second end of the slot and is then moved back to the first end of the slot as the arm reaches its maximum opening angle. By having the starting and ending position of the stopper pin at the same location, the spring moves a limited distance, and the spring housing rotates a much smaller degree of rotation than the arm; generally, less than one-third of the angular rotation of the arm relative to the first hinge end of the cuff. This permits the entire hinge assembly to be reduced in dimension, thereby permitting the hinge assembly to be incorporated into various jewelry pieces while retaining a low profile. In addition, by limiting rotation of the spring housing, by using a separate leaf spring, and by physically disengaging the leaf spring from the hinge assembly, the lifespan of the hinge assembly is increased, and retains a consistency of operation and pressure throughout its swing of movement. In an embodiment, the stack of flat springs forming the leaf spring reduces fatigue at the hinge relative to a single thicker spring and also produces a more consistent resistant and closing movement relative to a thicker single spring.

Other embodiments are provided.

DETAILED DESCRIPTION OF THE PREFERRED EMBODIMENTS

Figure 1:
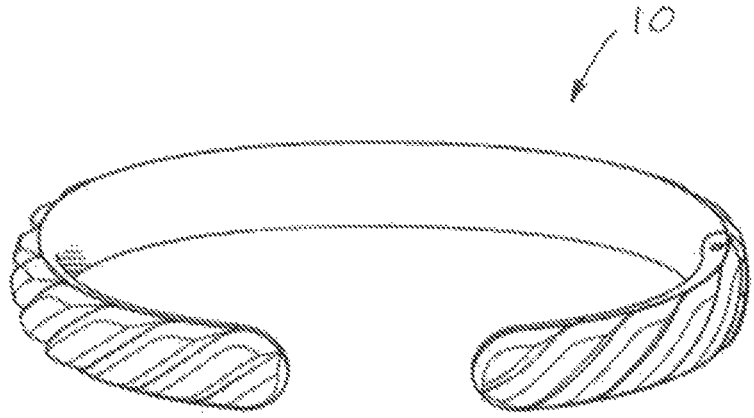
FIG. 1 is a bottom perspective view of a piece of jewelry in the form of a wrist cuff in a closed position.
Figure 2:
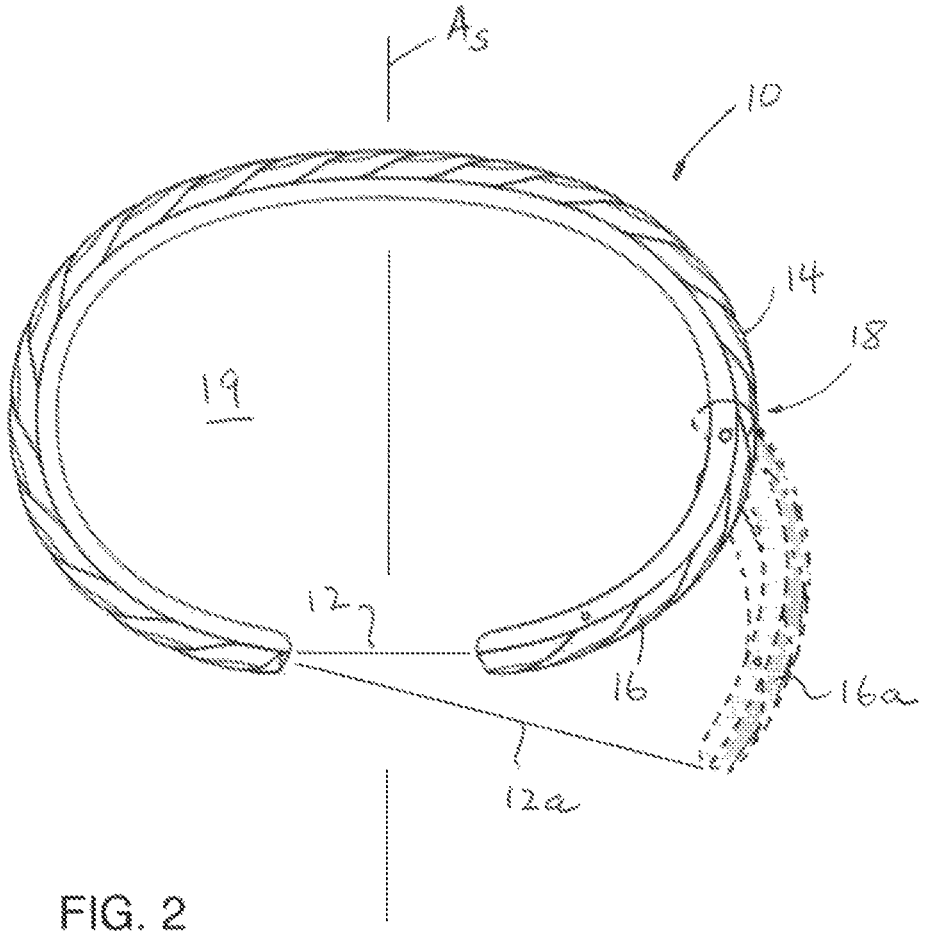
FIG. 2 is a side elevation view of the jewelry of FIG. 1 in a closed position.
Figure 3:
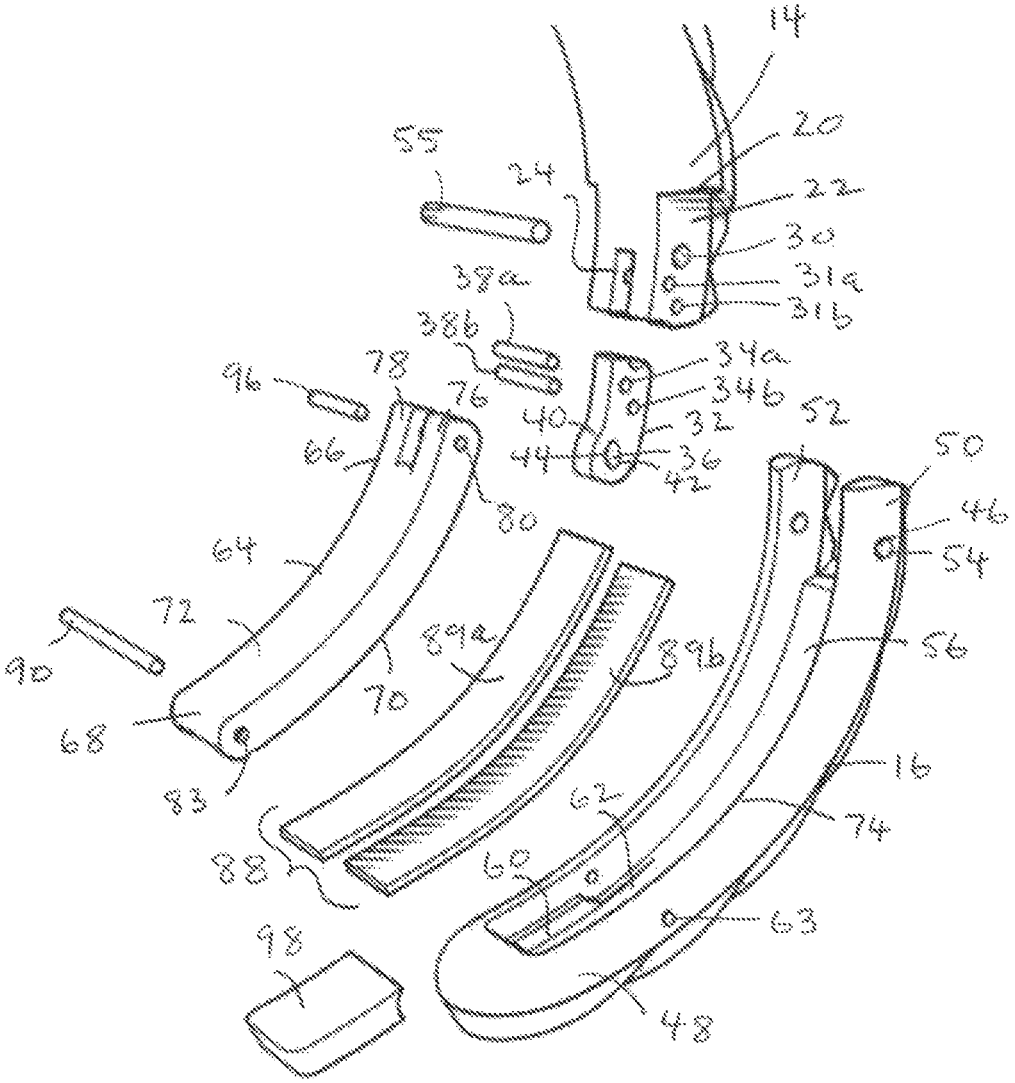
FIG. 3 is an exploded view of the hinge assembly of the jewelry of FIG. 1.
Figure 6:
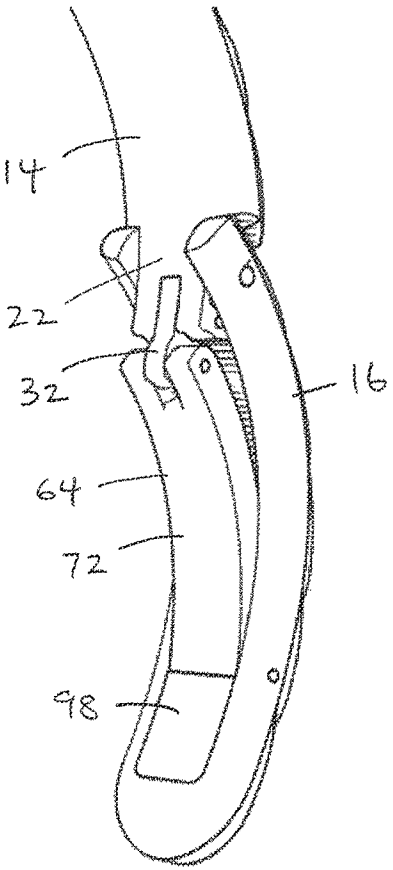
FIG. 6 is an enlarged perspective view of the jewelry of FIG. 1, with the arm in the fully open position.
Figure 5:
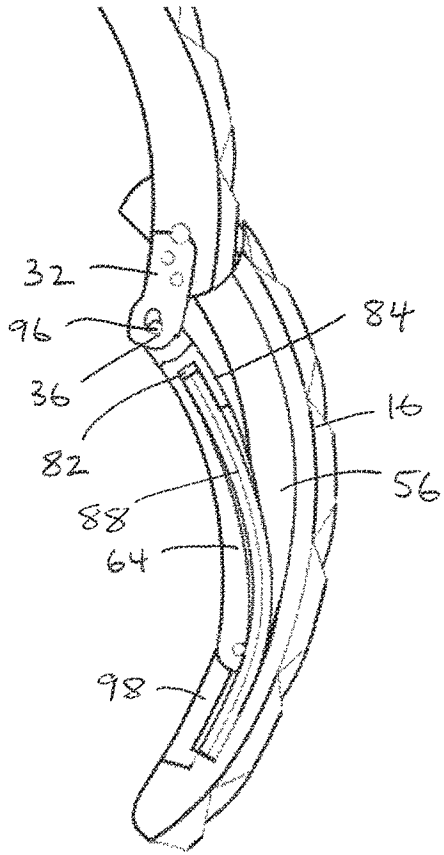
FIG. 5 is a cross-section view across line 5-5 in FIG. 4.
Figure 4:
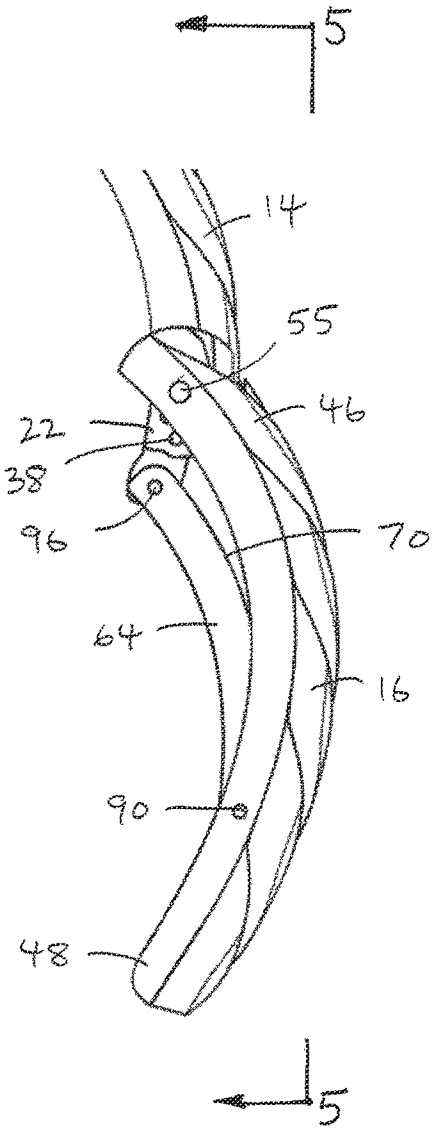
FIG. 4 is an enlarged side elevation view of the jewelry of FIG. 1, with the arm in the fully open position.

Referring to FIGS. 1 and 2, a piece of jewelry 10 defines a band in the form of a cuff adapted to extend more than 270° about a portion of a wearer, such as a wrist. The band 10 as shown is defines a partial oval circumference, but may be round, polygonal, or any other suitable shape adapted to fit or otherwise extend about a body part, such as the wrist, ankle, neck, ear lobe or finger. The band in the form of cuff 10 may include an opening 12 which is too small to release the body part. In addition, the band may be symmetrical or asymmetrical about an axis $A_s$ extending through the opening 12.

The cuff 10 includes a first hinge end 14 and an arm 16 rotatably coupled to the first hinge end at a hinge assembly 18. The arm 16 can be rotated open relative to the first hinge end 14 (as shown by 16*a* in broken lines) to enlarge the opening 12*a* and thereby permit a wearer's wrist to be received at an interior space 19 defined by the cuff. The arm 16 may then be closed such that the cuff is captured on the wearer's wrist. In a preferred embodiment, the hinge 18 is always biased toward a closed position such that the arm 16 is always urged closed and the dimension of the opening 12 is kept at the set minimum unless the cuff 10 is subject to an external opening force.

Turning now to FIGS. 3 through 6, the first hinge end 14 has a shoulder 20, and reduced width portion 22 extending from the shoulder. The reduced width portion 22 has a central recess 24 defining first and second fingers 26, 28. A first hinge bore 30 extends widthwise through portion 22, and a second coupling bore 31*a* extends widthwise through the fingers 26, 28 and across the central recess 24. A track element 32 is sized to fit between the fingers 26, 28 and includes a third coupling bore 34*a* that extends widthwise through the track element 32 and aligns with the second coupling bore 31*a*. The track element also includes a non-circular slot 36. The track element 32 is fixed in the central recess 24 between the first and second fingers 26, 28 with a fixation pin 38 that extends through the second and third coupling bores 31*a*, 34*a*. Optionally, additional coupling bore 31*b*, 34*b* may be provided for stability of the tracking element 32. A projection 40 of the track element 32 with the non-circular slot 36 extends outward from the fingers 26, 28. In an embodiment, the non-circular slot 36 has a flat surface 42 facing toward the outside of the cuff, a curved surface 44 facing toward the inside of the cuff, a lower first end 102 (FIG. 7A), and an upper second end (FIG. 8A). Alternatively, the track element may be a portion of; i.e., unitary with, the first hinge end 14.

The arm 16 has a second hinge end 46 and a free end 48. The second hinge end 46 has two fingers 50, 52 sized to fit about the portion 22 of the first hinge end 14 of the cuff 10. A second hinge bore 54 extends widthwise through the two fingers 50, 52 and a first hinge pin 55 couples the arm 16 to the first hinge end 14 such that the arm 16 is rotatable relative to the first hinge end 14. The arm 16 also includes an interior recess 56 extending from the second hinge end 46 toward the free end 48, a well 60, and a spring tunnel 62 that extends below the housing recess 56 and which opens at the lower end of the well 60. The arm 16 includes a third hinge bore 63 extending widthwise across the arm 16 and through the interior recess 56.

An elongate housing 64 includes a first end 66 and a second end 68. The housing 64 is sized to be received within the housing recess 56 of the arm 16. The housing 64 has a first surface 70 that matches the surface of the housing recess 56 of the arm, and a second surface 72 that allows the housing 64 to seat flush with an inner surface 74 of the arm 16. The first end 66 includes a pair of spaced apart fingers 76, 78 and a fourth hinge bore 80 extending widthwise through the fingers 76, 78, and the second end 68 includes a fifth hinge bore 83 extending widthwise across the housing. The housing 64 also includes a spring receiving channel 82 open to the first surface 70 and a retaining lip or other spring retainer structure 84 closing the spring receiving channel at the first surface 70 near the first end 66.

A leaf spring 88 is positioned in the spring receiving channel 82 of the housing, retained under the lip 84, and extends into the spring tunnel 62 under the lower end of the well 60. In an embodiment, the leaf spring 88 is constructed of a plurality of thinner flat springs 89*a*, 89*b*.

A second hinge pin 90 couples the second end 68 of the housing 64 to the free end 48 of the arm 16 at the third hinge bore 63. A stopper pin 96 extends through the fingers 26, 28 and the non-circular slot 36 of the track element 32 to couple the first end 66 of the housing 64 to the track element 32 at the slot 36. A cap 98 is secured in the well 60 to cover the end of the leaf spring 88. While the leaf spring 88 resides in the channel 82, it is not physically fixed to any hinge point. The leaf spring 88, positioned between the arm 16 and the housing 64, operates to bias the first end 66 of the housing 64 toward the arm 16 and thereby always urge the cuff 10 into a closed position; that is, the only stable position is a closed position such that the cuff is self-adapted to be retained on the user.

When it is intended to open the arm 16 of the cuff 10 relative to the first hinge end 14 of the cuff so that opening 12 (FIG. 2) can be enlarged to permit the jewelry to be worn or removed from a user, the cuff 10 and its hinge 18 are operated as follows.

Figure 7A:
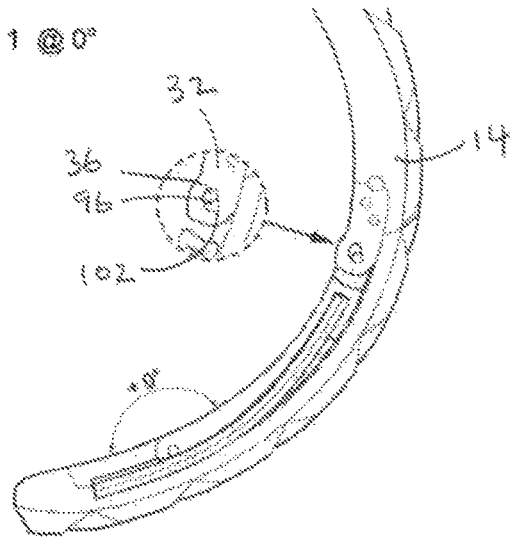
FIG. 7A is a cross-section view through a longitudinal axis of the free end of the cuff, the hinge assembly, and the arm, with the hinge in the closed position.
Figure 7B:
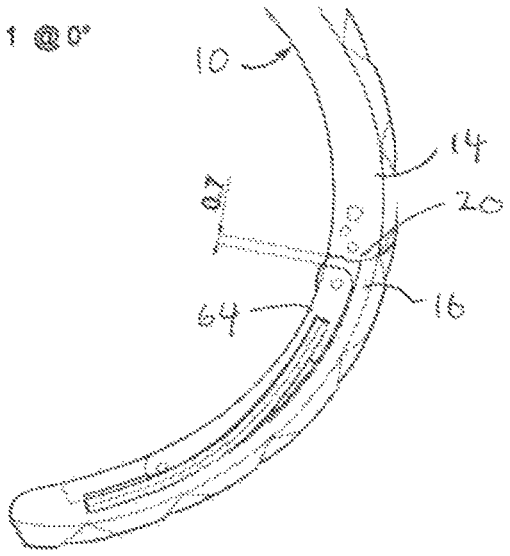
FIG. 7B is a cross-section view at an off-axis position through the free end of the cuff, the hinge assembly, and the arm, with the hinge in the closed position.
Figure 8A:
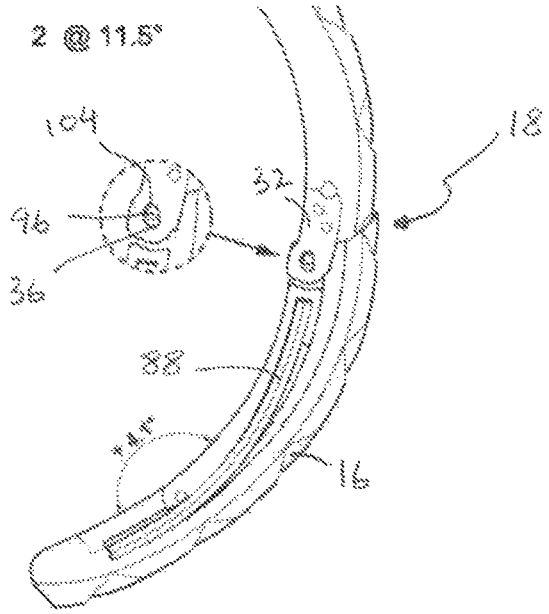
FIG. 8A is a cross-section view through a longitudinal axis of the free end of the cuff, the hinge assembly, and the arm, with the hinge open at 11.5°.
Figure 8B:
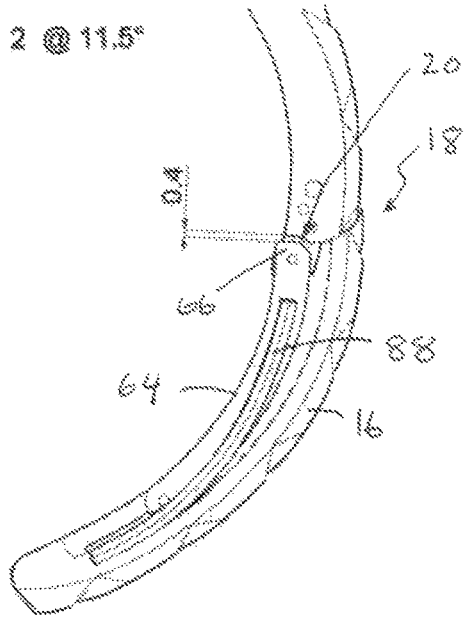
FIG. 8B is a cross-section view at an off-axis position through the free end of the cuff, the hinge assembly, and the arm, with the hinge open at 11.5°.
Figure 9A:
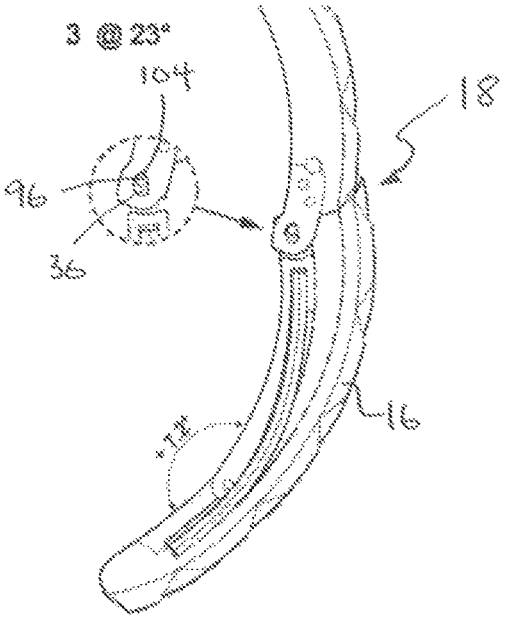
FIG. 9A is a cross-section view through a longitudinal axis of the free end of the cuff, the hinge assembly, and the arm, with the hinge open at 23°.
Figure 9B:
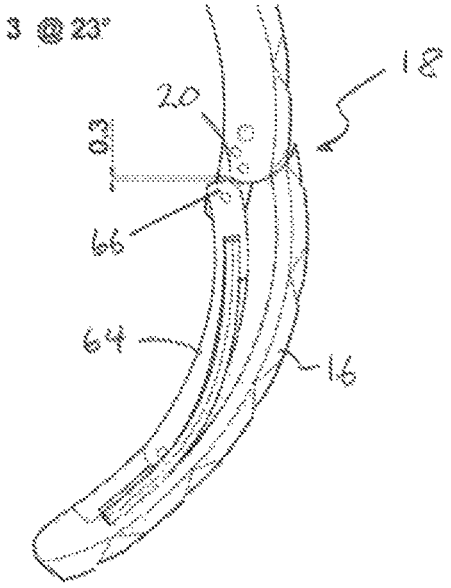
FIG. 9B is a cross-section view at an off-axis position through the free end of the cuff, the hinge assembly, and the arm, with the hinge open at 23°.
Figure 10A:
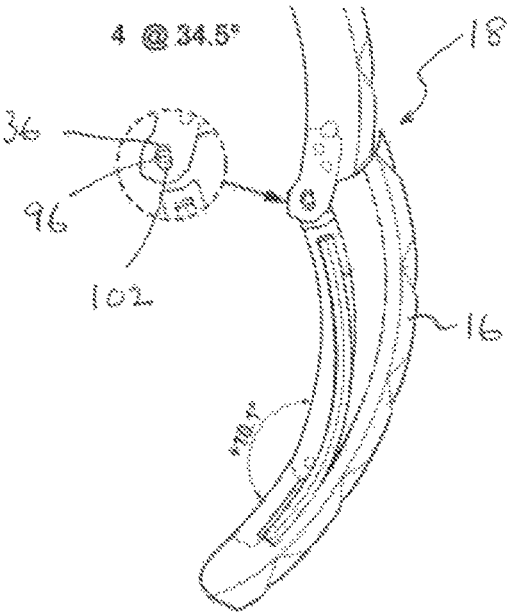
FIG. 10A is a cross-section view through a longitudinal axis of the free end of the cuff, the hinge assembly, and the arm, with the hinge open at 34.5°.
Figure 10B:
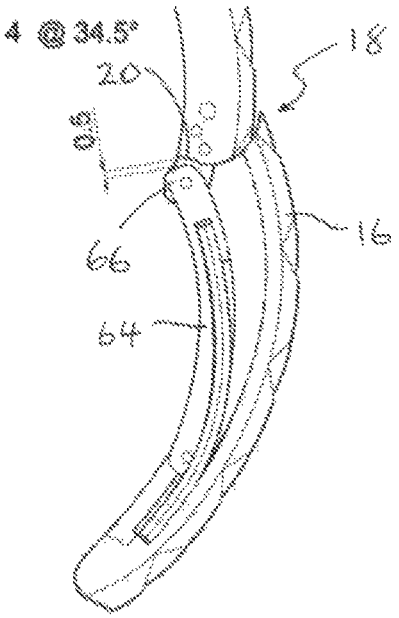
FIG. 10B is a cross-section view at an off-axis position through the free end of the cuff, the hinge assembly, and the arm, with the hinge open at 34.5°.
Figure 11A:
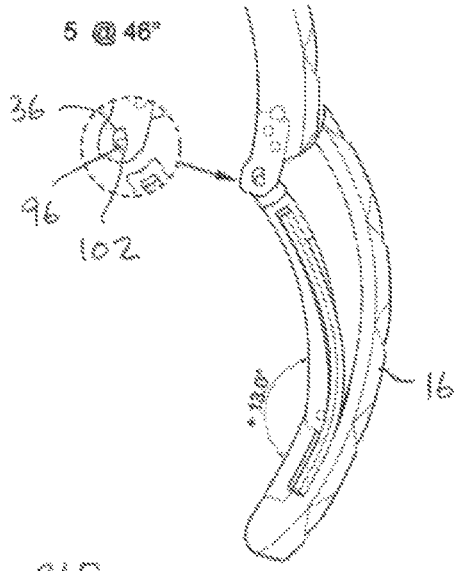
FIG. 11A is a cross-section view through a longitudinal axis of the free end of the cuff, the hinge assembly, and the arm, with the hinge open at 46°.
Figure 11B:
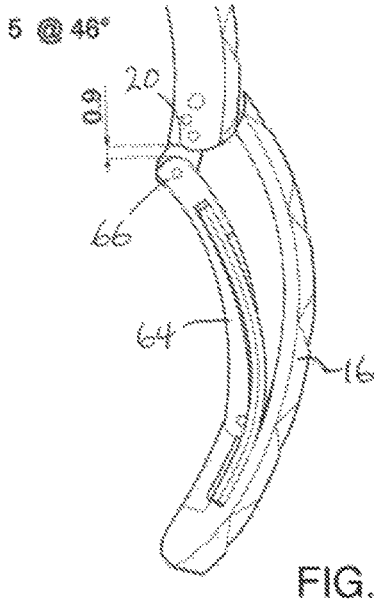
FIG. 11B is a cross-section view at an off-axis position through the free end of the cuff, the hinge assembly, and the arm, with the hinge open at 46°.

Referring to FIGS. 7A and 7B, when the cuff 10 is in the closed position, the hinge assembly is fully recessed into the cuff and arm. (See also FIG. 13). In the closed position, the stopper pin 96 is at the first end 102 of the slot 36, and the first end 66 of the housing 64 is at a first distance from the shoulder 20 of the first hinge end 14 of the cuff 10. Then, referring to FIGS. 8A and 8B, as the arm 16 is partially rotated at hinge assembly 18 (shown at rotational angle of 11.5° relative to the starting position) against the bias of the leaf spring 88, the stopper pin 96 advances within slot 36 of the track element 32 toward the second end 104 of the slot 36, and the first end 66 of the housing 64 advances toward the shoulder 20, reducing the space between the first end 66 of the housing and the shoulder 20 to a second distance. Turning to FIGS. 9A and 9B, the arm 16 is shown further rotated at hinge assembly 18 into a half-way open position (with 23° of movement relative to the closed starting closed position). In the half-open position, the stopper pin 96 preferably extends all the way to the second end 104 of the slot 36, and the distance between the first end 66 of the housing 64 and the shoulder 20 is a minimum or third distance. Then, referring to FIGS. 10A and 10B, as the arm 16 is rotated further open at the hinge assembly 18 (shown at an angle of 34.5° rotation relative to the starting position), the stopper pin 96 tracks back toward the lower first end 102 of the slot 36, and the distance between the first end 66 of the housing 64 and the shoulder 20 begins to increase to a fourth distance. Turning now to FIGS. 11A and 11B, as the arm 16 is rotated into a fully open position of 46° relative to a starting position, the stopper pin 96 returns to its starting point at the lower first end 102 of the slot 36 and the distance between the first end 66 of the housing 64 and the shoulder 20 is increases to a fifth distance.

In the exemplar embodiment shown, the first distance is 0.7 mm, the second distance is 0.4 mm, the third distance is 0.3 mm, the fourth distance is 0.5 mm, and the fifth distance is 0.9 mm. However, the distances can be tailored based on the type and size of the jewelry, the particular piece of jewelry, the amount of angular swing intended for opening the arm relative to a starting position, tolerances required, and/or other manufacturing and design considerations.

It should be recognized from the above, that as the arm 16 is rotated from a closed to open position, the stopper pin 96 starts at a first end of the slot, is displaced to an opposite second end of the slot and then is moved back to the first end of the slot as the arm reaches its maximum opening angle. By having the starting and ending position of the stopper pin at the same location, the spring moves a limited, shorter distance, and the spring housing rotates a much smaller degree of rotation than the arm; generally, less than one-third of the angular rotation of the arm relative to the first hinge end of the cuff. This permits the entire hinge assembly to be reduced in dimension, thereby permitting the hinge assembly to be incorporated into various jewelry pieces while retaining a low profile. In addition, by limiting rotation of the spring housing, the lifespan of the hinge assembly is increased, and retains a consistency of operation and pressure throughout its swing of movement. In an embodiment, the stack of flat springs forming the leaf spring reduces fatigue at the hinge relative to a single thicker spring and also produces a more consistent resistant and closing movement relative to a thicker single spring.

Figure 12:
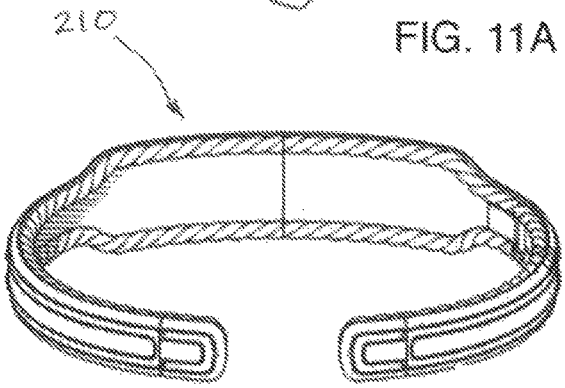
FIG. 12 is a bottom perspective view of a piece of jewelry in the form of a wrist cuff in a closed position.
Figure 13:
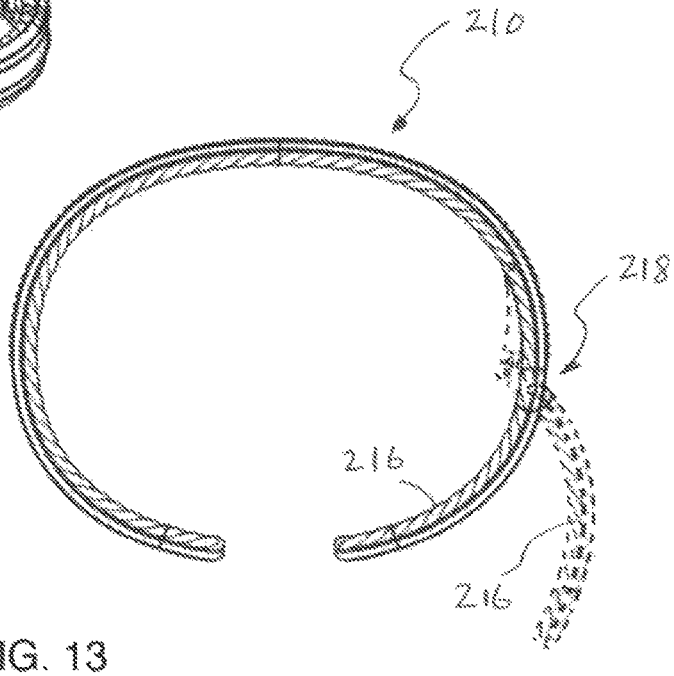
FIG. 13 is a side elevation view of the jewelry of FIG. 12 in a closed position.
Figure 14:
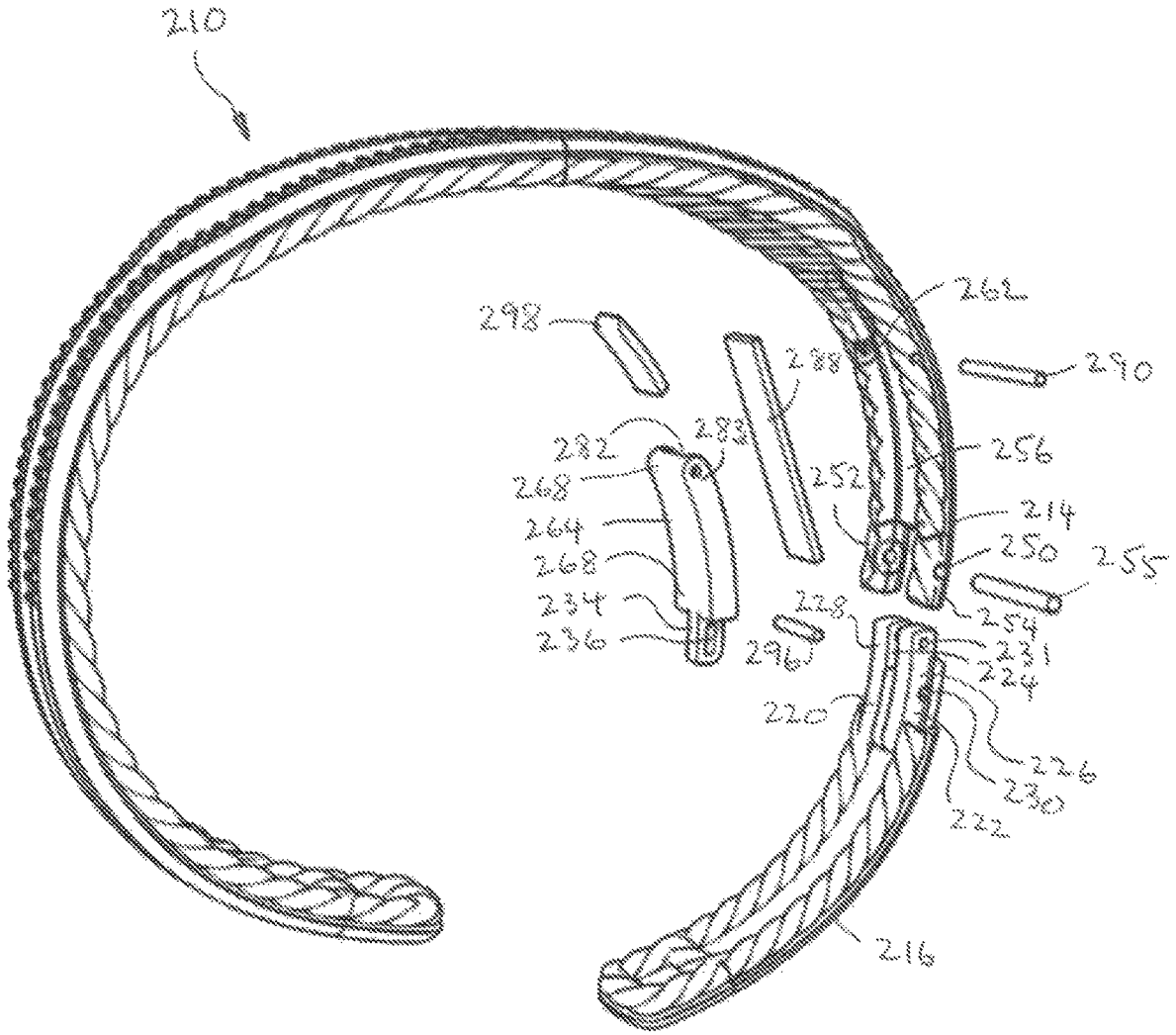
FIG. 14 is an exploded view of the hinge assembly of the jewelry of FIG. 12.
Figure 17:
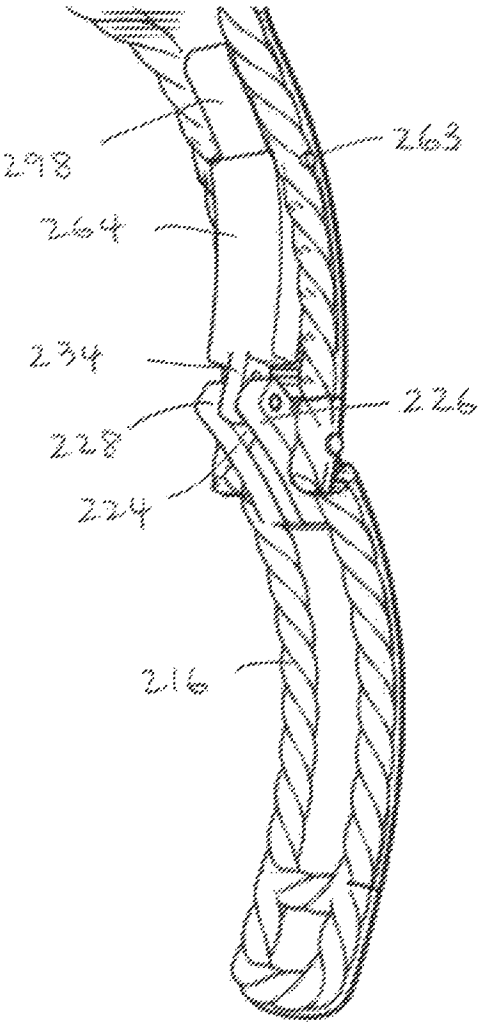
FIG. 17 is an enlarged perspective view of the jewelry of FIG. 12, with the arm in the fully open position.

Turning now to FIGS. 12 and 13, another piece of a jewelry in the form of a cuff or band with a hinge assembly is shown. The piece of jewelry is a wrist cuff 210 having an arm 216 rotatable open about a hinge assembly 218, similar to the movement in cuff 10. Arm 216 is shown in open position as arm 216*a* in broken lines in FIG. 13. While operation is substantially similar from a user's perspective, in distinction from cuff 10, the hinge end 214 of the cuff 210 includes an interior housing recess 256 in its inner wall, and a first pair of spaced apart fingers 250, 252 extending from the hinge end 214. A first hinge bore 254 extends widthwise through the first fingers 250, 525. A rear spring channel 262 is defined at end of the interior housing recess 256 opposite the hinge end 214. A second hinge bore 263 extends widthwise across the hinge end and through the housing recess 256.

The arm 216 includes a shoulder 220 and a narrower projection 222 extending from the shoulder and sized to fit between the first pair of fingers 250, 252. The projection 222 defines a second pair of fingers 226, 228 and a second central recess 224 therebetween. A third hinge bore 230 extends widthwise across the projection 222 adjacent the shoulder 220, and fourth hinge bore 231 extends widthwise across the projection 222 through the second pair of fingers 226, 228 and the second central recess 224. The projection 222 of the arm 216 is inserted between the first pair of fingers 250, 252 of the hinge end of the cuff. A first hinge pin 255 extends through the first and third hinge bores 254, 230 to rotatably couple the arm 216 to the hinge end 214 of the cuff.

A housing 264 includes a first end 268 and a second end 266. The first end 268 includes a fourth hinge bore 283, and the second end 266 includes projection 234 with an elongate slot 236. The housing 264 also includes a spring channel 282 and spring retaining lip 284 at the second end 266 of the housing. A second hinge pin 290 extends through the second and fourth hinge bores 263, 283 to rotatably couple the housing 264 to the free end 214 of the cuff. The projection 234 of the housing 264 extends between the second pair of fingers 226, 228 on the arm 216, and a stopper pin 296 is fixed in the second pair of fingers and slidably received in the elongate slot 236.

A leaf spring 288, preferably in the form of multiple thinner leaf springs sandwiched together, is provided in the spring channel 282. The leaf spring 288 is preferably flat or substantially flat. A first end of the leaf spring 288 is retained under the retaining lip 284, and a second end is provided in the rear spring channel 262 of the hinge end 214 of the cuff. A cap 298 retains the second end of the spring 288. The leaf spring 288 always biases the arm 216 into a closed position relative to the free end 214 of the cuff.

Figure 16:
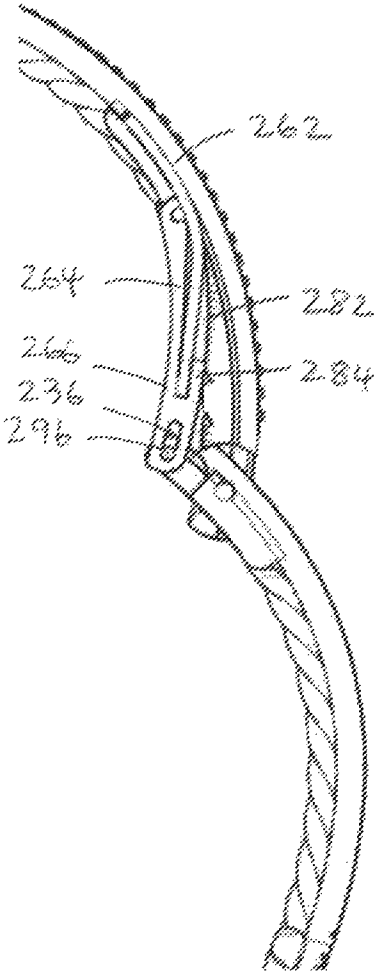
FIG. 16 is an enlarged cross-section view through the free end of the cuff, the hinge assembly, and the arm, with the arm in the fully open position.
Figure 15:
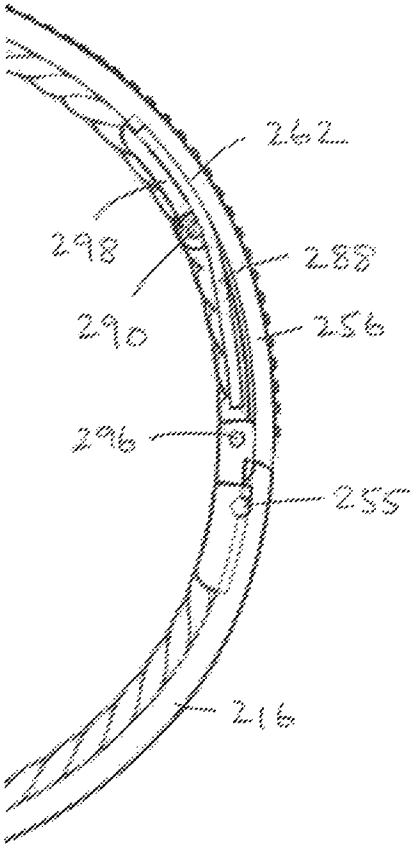
FIG. 15 is an enlarged partial section of the jewelry, with the arm in the closed position.

Referring to FIG. 15, in the closed position, the stopper pin 296 is at a first end of the elongate slot 236. Then, turning to FIG. 16, when the arm 216 is rotated open relative to the free end 214 of the cuff and against the bias of the leaf spring, the housing 264 is rotated on the second hinge pin 290 and the stopper pin 296 advances to a second end of the elongate slot 236, such that the stopper pin 296 and elongate slot 236 operate to define the maximum opening angle of the arm 216 relative to the cuff.

In distinction from hinge assembly 18 in which the leaf spring and leaf spring housing are retained at the movable arm, in hinge assembly 218, the leaf spring and leaf spring housing are retained in the stationary cuff and the stopper pin 296 travels in only one direction relative to the elongate slot as the arm is rotated from the closed to fully open position. In addition, the path of stopper pin is fully linear.

Each hinge assembly is a low-profile assembly that permits opening and closing, requires few movable parts, has high reliability and repeatability, and does not interfere with the outward design of the jewelry.

There have been described and illustrated herein embodiments of jewelry and a hinge assembly for jewelry. While particular embodiments of the invention have been described, it is not intended that the invention be limited thereto, as it is intended that the invention be as broad in scope as the art will allow and that the specification be read likewise. Thus, while particular the exemplar embodiments have been specifically described with respect to wrist cuffs, it will be appreciated that the hinge assembly may be incorporated into any jewelry piece that has a rigid shape and requires opening at a hinge to wear upon a user. Thus, the intended jewelry piece should at least extend more than 180° about a body part of a user, and more preferably will substantially extend about the body part, i.e., at least 300°, and even up to or greater than 330°. Further, while the particularly described piece has an opening that is enlarged by the hinge, it is appreciated that the hinge assembly can be used in jewelry that forms a closed perimeter, and which is only opened by operation of the hinge assembly. It will therefore be appreciated by those skilled in the art that yet other modifications could be made to the provided invention without deviating from its scope as claimed.

What is claimed is:

1. A piece of jewelry, comprising:

a) a first rigid portion of a band element;

b) a second rigid portion of the band element rotatably coupled to the first rigid portion at a first pivot point, the first and second rigid portions together adapted to at least substantially extend about a portion of a user's body when in a closed position;

c) a spring housing having a first end and a second end, the first end rotatably coupled to the second rigid portion;

d) a stopper pin; and e) a spring received in the spring housing and urging the second end of the spring housing toward the second rigid portion, wherein the second end of the spring housing and the first rigid portion are longitudinally displaceable relative to each other and coupled by the stopper pin, wherein the stopper pin limits angular rotation of the first rigid portion and the second rigid portion relative to each other.

2. The piece of jewelry of claim 1, wherein the band element is a wrist cuff.

3. The piece of jewelry of claim 1, wherein the spring is a leaf spring.

4. The piece of jewelry of claim 3, wherein the leaf spring is a plurality of thinner flat springs.

5. The piece of jewelry of claim 1, wherein the first and second rigid portions are always urged by the spring into the closed position about the first pivot point.

6. The piece of jewelry of claim 1, wherein one of the first rigid portion and second rigid portion is provided with the stopper pin, and the other of the first rigid portion and second rigid portion is provided with an elongate slot through which the stopper pin longitudinally displaces.

7. The piece of jewelry of claim 6, wherein the stopper pin cycles from a first end of the elongate slot to a second end of the elongate slot and back to the first end of the elongate slot as the first and second rigid portions are rotated relative to each other from the closed position to a fully open position.

8. The piece of jewelry of claim 6, wherein the stopper pin cycles from a first end of the elongate slot to a second end of the elongate slot as the first and second rigid portions are rotated relative to each other from the closed position to a fully open position.

9. A piece of jewelry, comprising:

a) a rigid first jewelry portion having a hinge end;

b) a rigid arm having a first end and a free end;

c) a hinge about which the first end of the rigid arm is rotatable relative to the hinge end of the rigid first jewelry portion;

d) a track portion at the hinge end of the rigid first jewelry portion, the track portion defining an elongate slot;

e) a stopper pin;

f) a spring housing having a first end and a second end, the first end of the spring housing rotatably coupled to the rigid arm, and the second end of the spring housing coupled to the track portion at the elongate slot with the stopper pin such that the second end of the spring housing is longitudinally displaceable relative to the track portion;

g) a spring biasing the spring housing toward the rigid arm which, in turn, biases the rigid arm to rotate about the hinge toward a closed position.

10. The piece of jewelry of claim 9, wherein when the rigid first jewelry portion and the rigid arm have respective inner and outer surfaces, and when the piece of jewelry is in the closed position, the hinge, track portion, spring housing, and spring do not protrude from any of the respective inner and outer surfaces.

11. The piece of jewelry of claim 9, wherein the piece of jewelry is a wrist cuff.

12. The piece of jewelry of claim 9, wherein the spring is at least partially in the spring housing and at least partially in the rigid arm.

13. The piece of jewelry of claim 9, wherein the spring is comprised of a plurality of flat leaf springs.

14. The piece of jewelry of claim 9, wherein the rigid arm is always urged by the spring into the closed position relative to the rigid first jewelry portion.

15. The piece of jewelry of claim 9, wherein the stopper pin cycles from a first end of the elongate slot to a second end of the elongate slot and back to the first end of the elongate slot as the rigid arm is rotated relative to the rigid first jewelry portion from the closed position to a fully open position.

16. A piece of jewelry, comprising:

a) a rigid first jewelry portion having a hinge end;

b) a rigid arm having a first end and a free end;

c) a hinge about which the rigid arm is rotatable relative to the hinge end of the rigid first jewelry portion;

d) a spring housing having a first end and a second end, the first end of the spring housing rotatably coupled to the rigid first jewelry portion, and the second end of the spring housing provided with a track portion having an elongate slot;

e) a stopper pin extending through the elongate slot and coupling the first end of the rigid arm to the track portion of the spring housing;

f) a leaf spring biasing the spring housing toward the rigid first jewelry portion which, in turn, biases the rigid arm to rotate about the hinge toward a closed position.

17. The piece of jewelry of claim 16, wherein when the rigid first jewelry portion and rigid arm have respective inner and outer surfaces, and when the piece of jewelry is in the closed position, the hinge, spring housing, and leaf spring do not protrude from any of the respective inner and outer surfaces.

18. The piece of jewelry of claim 16, wherein the piece of jewelry is a wrist cuff.

19. The piece of jewelry of claim 16, wherein the leaf spring is at least partially in the spring housing and at least partially in the rigid first jewelry portion.

20. The piece of jewelry of claim 16, wherein the leaf spring comprises a stack of thinner flat springs.

21. The piece of jewelry of claim 16, wherein the rigid arm is always urged by the leaf spring into the closed position relative to the rigid first jewelry portion.

22. The piece of jewelry of claim 16, wherein the stopper pin cycles from a first end of the elongate slot to a second end of the elongate slot as the rigid arm is rotated relative to the rigid first jewelry portion from the closed position to a fully open position.

* * * * *